United States Patent [19]

Andrews

[11] 4,005,779

[45] Feb. 1, 1977

[54] TIGHTLINE LOGGING SYSTEM

[76] Inventor: Cecil L. Andrews, P.O. Box 214, Burney, Calif. 96013

[22] Filed: Feb. 18, 1975

[21] Appl. No.: 550,298

Related U.S. Application Data

[63] Continuation of Ser. No. 472,227, May 22, 1974, abandoned, which is a continuation of Ser. No. 321,348, Jan. 15, 1973, abandoned.

[52] U.S. Cl. ..... 212/7; 212/87; 254/139.1

[51] Int. Cl.[2] ..... B66C 17/06

[58] Field of Search ..... 254/139.1, 145, 184, 254/193, 194; 212/76, 77, 81, 87, 84, 89, 91–97, 7, 119, 117, 122; 214/3

[56] References Cited

UNITED STATES PATENTS

| | | | |
|---|---|---|---|
| 2,382,049 | 8/1945 | Frankhouser | 254/193 |
| 2,491,069 | 12/1949 | Anderson et al. | 254/194 |
| 3,033,526 | 5/1962 | Priest | 254/139.1 |
| 3,083,839 | 4/1963 | McIntyre | 212/89 |
| 3,094,222 | 6/1963 | McAllister | 212/87 |
| 3,201,091 | 8/1965 | Woolslayer et al. | 254/139.1 |
| 3,237,353 | 3/1966 | Gilmore | 254/139.1 |
| 3,247,933 | 4/1966 | Hanna | 212/92 |
| 3,850,304 | 11/1974 | Howell | 212/87 |

*Primary Examiner*—Robert J. Spar
*Assistant Examiner*—Kenneth Noland
*Attorney, Agent, or Firm*—Klarquist, Sparkman, Campbell, Leigh, Hall & Whinston

[57] ABSTRACT

A carriage carrying a match block moves away from a slider by gravity along a tightline from a mast of the slider, and is pulled back to the slider with a turn of logs by a mobile mainline unit of a skidder. The tightline then is lower the carriage, and the mainline may be freed from the block to permit the mainline unit to move the logs to a loading station or the turn of logs may be detached from the mainline and the operation repeated.

11 Claims, 7 Drawing Figures

76
32
74
42
46
56
58
34
35
30
50
134
128
132
20
144
36
90
106
114
38
140
52
22
44
72
78
110
108
40
26
24
127
124
104

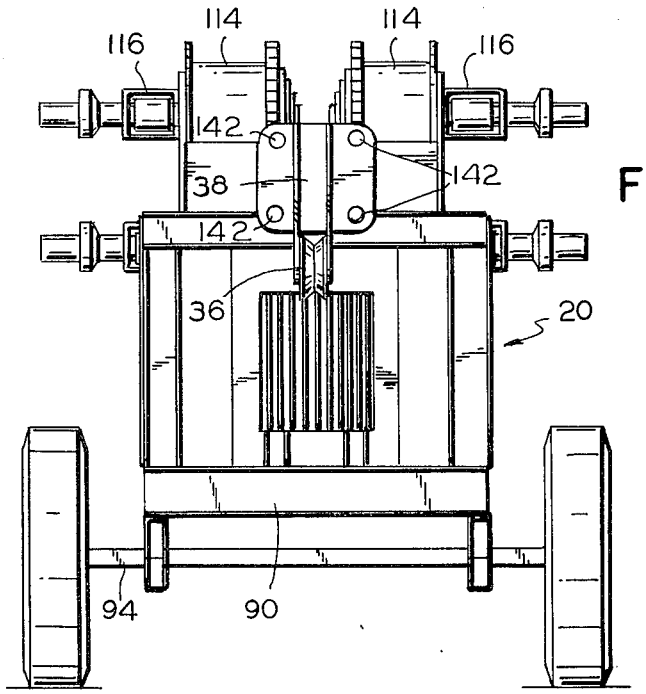
FIG. 5
FIG. 6
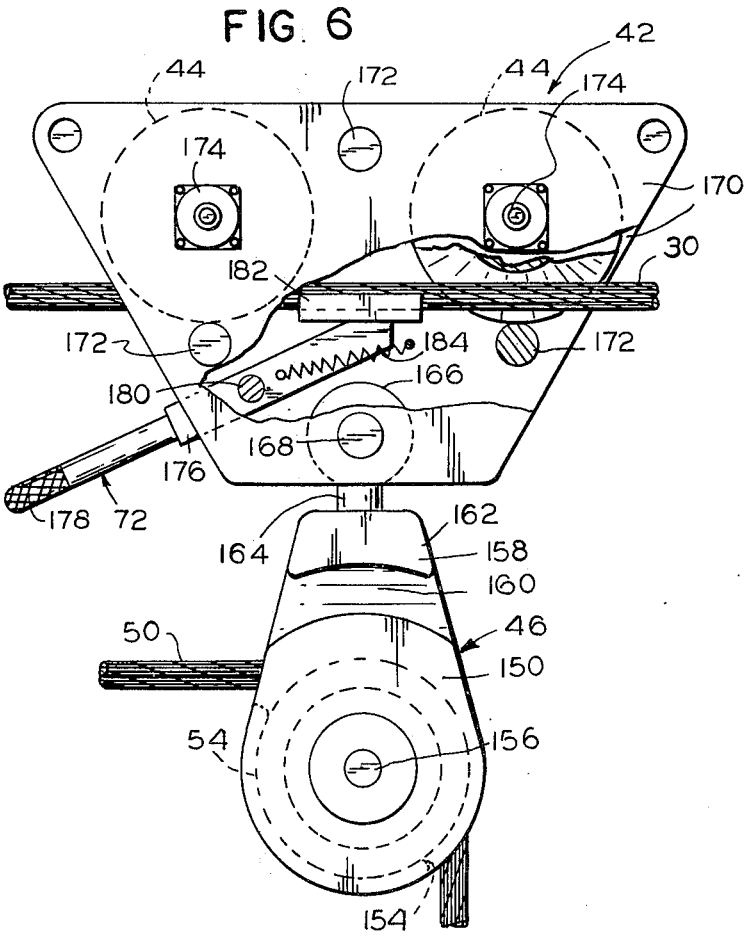
FIG. 7
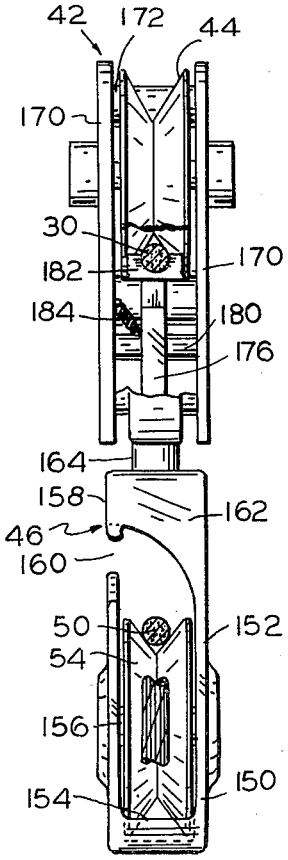

TIGHTLINE LOGGING SYSTEM

This is a continuation of application Ser. No. 472,227, filed May 22, 1974 now abandoned which, in turn, is a continuation of application Ser. No. 321,348, filed Jan. 15, 1973, now abandoned.

DESCRIPTION

This invention relates to a new and improved tightline logging system, and more particularly to a tightline logging system using a mobile mainline unit.

An object of the invention is to provide a new and improved tightline logging system.

Another object of the invention is to provide a tightline logging system using a mobile mainline unit.

A further object of the invention is to provide a tightline logging system in which a slider vehicle has a tightline for sliding a carriage out by gravity and controls elevation of the carriage, and the carriage is pulled back with a load by a mainline drawn by a winch of a skidder.

Another object of the invention is to provide a tightline logging system in which a mainline pulls a carriage and a load up and along a tightline and the tightline may be lowered to deposit the load and may also be lowered to make the mainline outer end and the carriage convenient to a choke-setter.

Another object of the invention is to provide a tightline logging system in which a carriage is slid out by gravity along a tightline to carry out a block and a mainline outer end, the tightline is slacked, a turn of logs is secured to the mainline outer end, the tightline is tightened to raise the turn of logs, the mainline is taken in to pull the carriage in along the tightline, and the tightline is slacked to lower the carriage and the turn of logs.

Another object of the invention is to provide a tightline logging system in which a turn of logs is attached to a mainline of a skidder extending through a block supported by a carriage on the tightline and the block is constructed to permit the mainline to be moved laterally therefrom.

In the drawings:

FIG. 5 is an end view of the slider of FIG. 3;

FIG. 6 is an enlarged, fragmentary, side elevation view of a carriage and block of the tightline logging system of FIG. 1; and FIG. 7 is an enlarged end view of the carriage and block of FIG. 5.

Figures 1, 2:
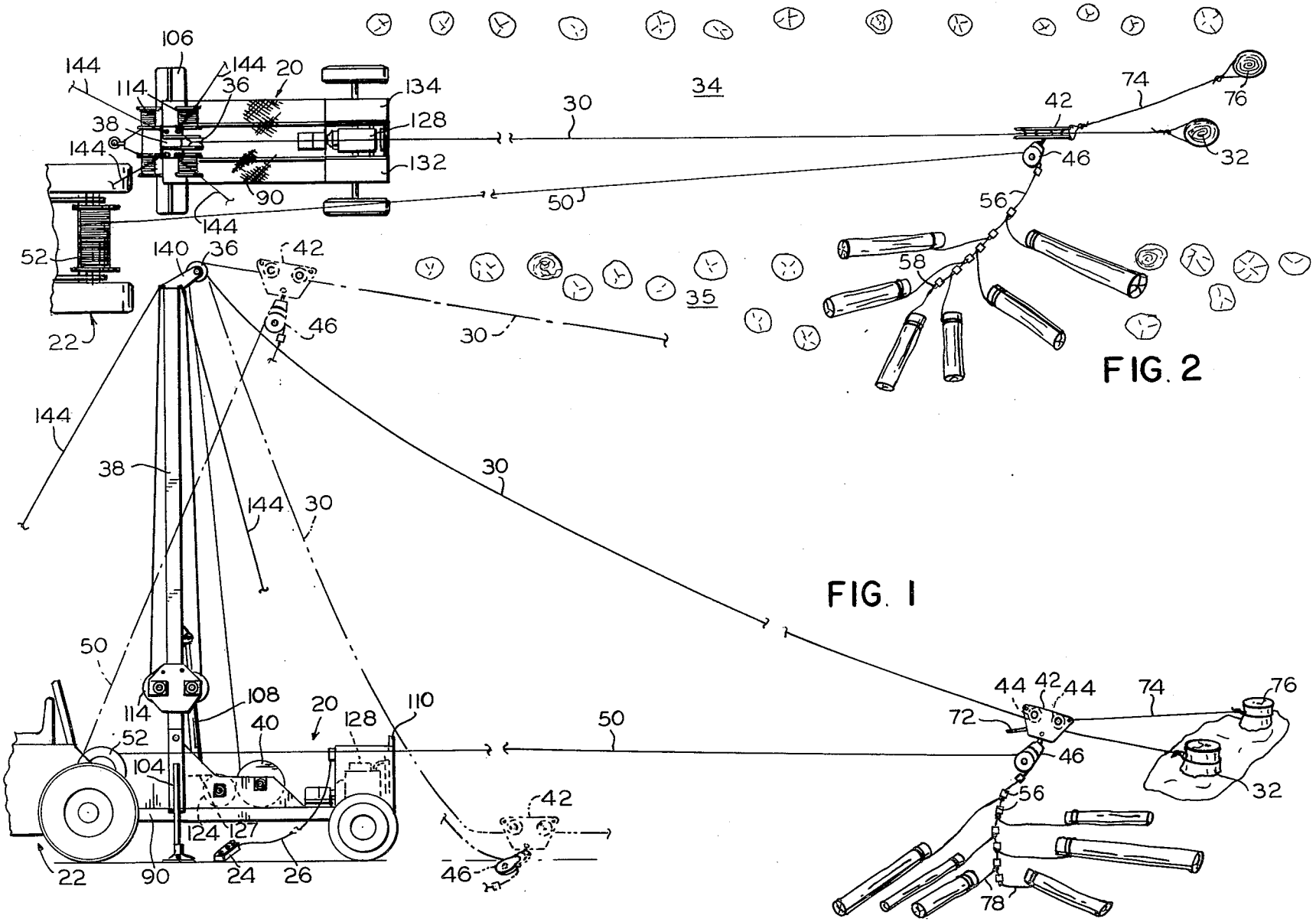
FIG. 1 is a fragmentary top plan view of a tightline logging system forming one embodiment of the invention.
FIG. 2 is a fragmentary side elevation view of the tightline logging system of FIG. 1.

Referring now in detail to the drawings, there is shown therein a tightline logging system forming one embodiment of the invention, and used with tightline logging methods forming further embodiments of the invention. A slider 20 and a conventional, rubber-tired, skidder 22 constituting a mobile mainline unit are the only power equipment included, and both are controlled completely by a single skidder operator who controls the slider operation from the skidder or from a position between the skidder and the slider by a remote control means including a switch box 24 connected to the slider by a control line 26 or mounted on a panel at the side of the slider, a similar remote control (not shown) being provided for controlling the mainline winch. A tightline 30 is anchored to a stump 32 at its outer end, and extends upwardly and along a narrow (10 feet wide) path 34, which has been cut in a forest 35 by conventional methods and has been removed with the slider. The remote control means also includes a switch box (not shown) like the switch box 24 and a line extending along the path to the working area of a choker setter, the remote control of the choker setter being adapted to selectively override or block out the control of the skidder operator. The tightline extends to a sheave 36 at the upper end of a spar or mast 38 of the slider. The tightline 30 goes down from the sheave to a tightline drum 40 of the slider. A carriage 42 supported by pulleys 44 on the tightline carries a block 46, and a mainline 50 from a mainline drum 52 on the skidder extends from the drum around a sheave 54 of the block and has choker slides 56 and nubbins 58 on the portion thereof outward beyond the block. The drum or winch 52 is a conventional skidder winch and may be selectively set in braked, free spool or powered takeup condition.

In operation, to get a turn of logs, with the tightline 30 tight and the carriage 42 held up and near the mast 38 by the mainline, the uppermost one of the choker slides 56 abuting the block 46 and being unable to pass through the block, the skidder operator releases the brake on the mainline drum 52 of the skidder to put the mainline drum in free spool. Gravity then moves the carriage 42 out and the mainline 50 is pulled therewith. When the carriage is at the desired location, a choker setter standing out along the path 34 signals the skidder operator to stop the carriage. The skidder operator then sets the brake on the mainline drum and the mainline stops further travel out of the carriage. The skidder operator then releases (by remote control) a tightline brake 70 of the tightline drum, and the tightline 30 is lowered by the tightline drum 40 to lower the carriage 42 to about head height. The tightline brake 70 is then reset. The choker setter then actuates a one-way brake 72 on the carriage to prevent further movement out of the carriage. In thinning, if the logs to be picked up are located toward the side or toward the slider from the carriage, the choker setter secures an anchor line 74 to the carriage and to a stump or other anchor 76 located outwardly from the carriage. The skidder operator then releases the mainline brake, and the choker setter pulls the outer end of the mainline 50 to chokers 78 secured to logs and attaches the chokers to the choker slides 56 in the conventional way. The choker setter then signals the skidder operator who then drives the mainline drum 52 in the takeup direction until the turn of logs held by the chokers is pulled to the carriage 42. If the anchor line 74 has been hooked to the carriage, the mainline then is stopped and the anchor line 74 is unhooked from the carriage. Then the skidder operator drives the tightline drum 40 in takeup to tighten the tightline 30 to raise the carriage and logs, and the mainline 50 is taken up by the skidder drum 52 until the carriage is near the slider. Then the tightline 30 is slackened to lower the logs and the block 46 to the ground. The chokers can then be detached from the logs, or, if desired, the mainline is moved sidewise out of the block, and the skidder is operated to pull the logs to a nearby loading station, the chokers are then detached from the logs, the skidder is returned to its initial position and the mainline placed in the block again. Then the tightline is tightened which raises the block, and the operation described above is repeated.

Figure 3:
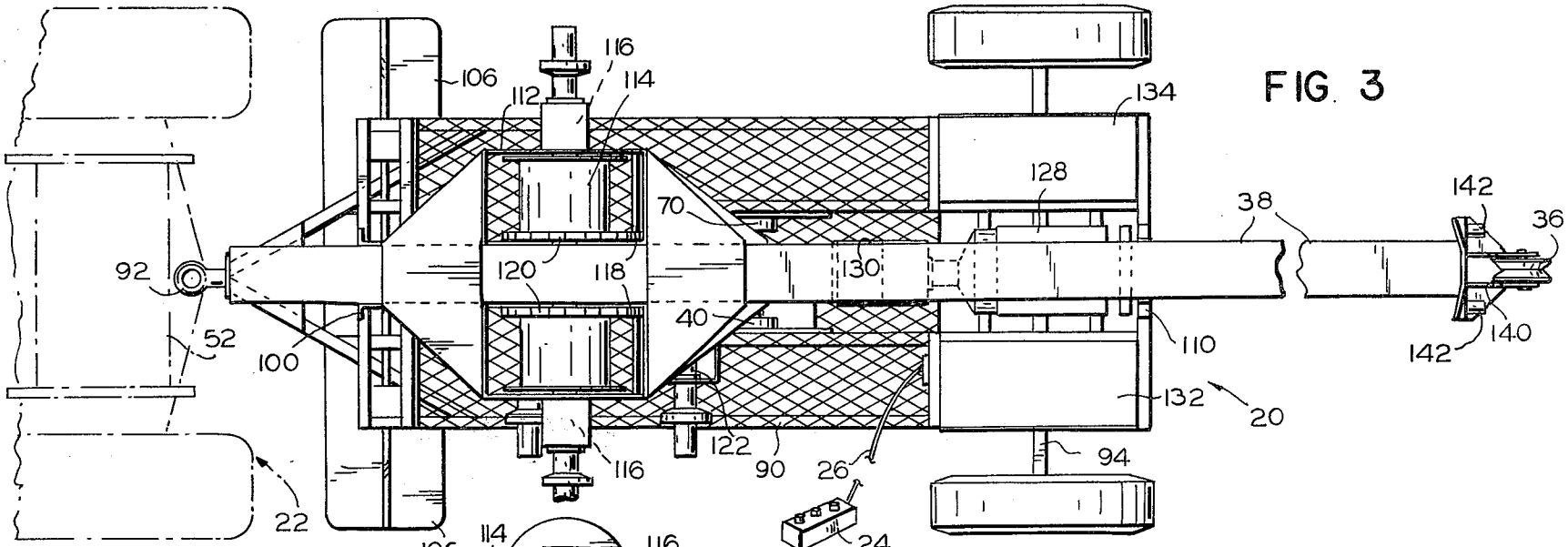
FIG. 3 is an enlarged, fragmentary, top plan view of a slider of the tightline logging system of FIG. 1.
Figure 4:
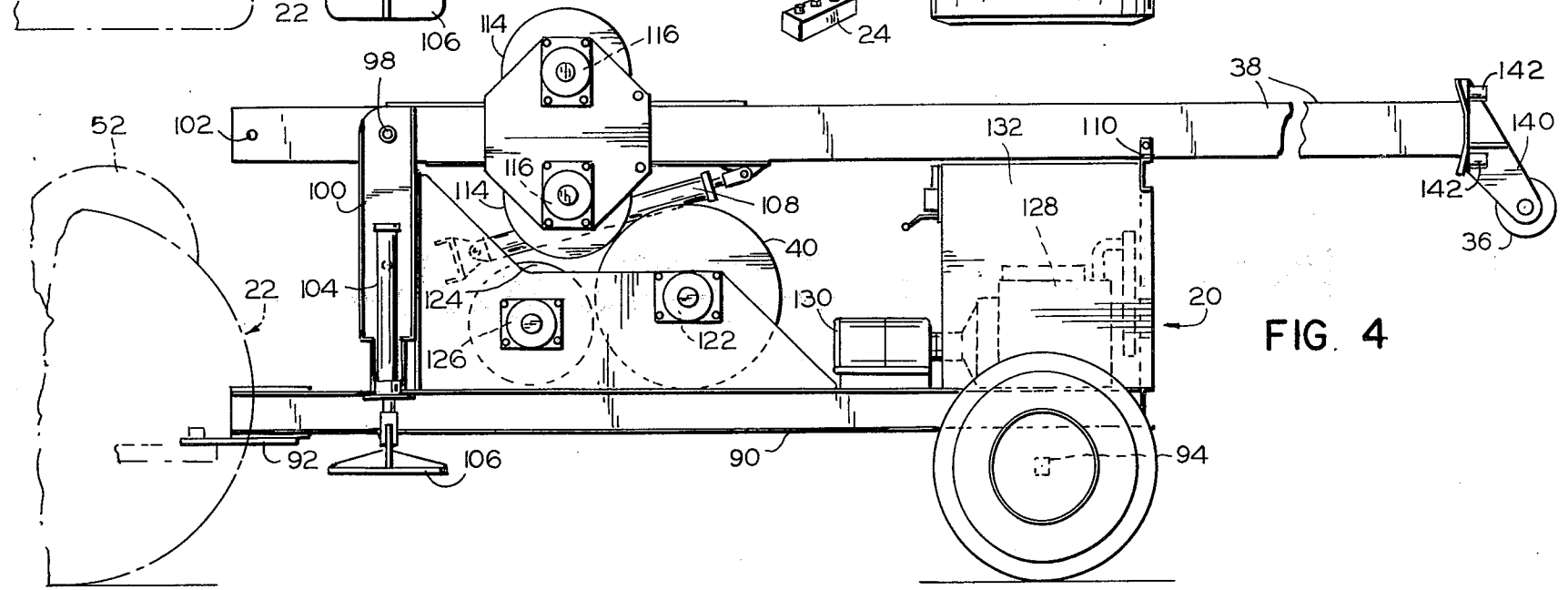
FIG. 4 is an enlarged, fragmentary, side elevation view of the slider of FIG. 3.

The slider 10 (FIGS. 1 to 5) includes a trailer frame 90 having a trailer hitch 92 and one or more wheeled axles 94. The mast 38 is pivotally mounted on a pin 98 carried by an upright fork 100, and a locking pin (not shown) may be inserted through holes in the fork 100 and a hole 102 in the mast to lock the mast in upright position. Extensible hydraulic cylinder bracing legs 104 carrying ground engaging shoes 106 are secured to the frame. The mast 38 is movable by a hydraulic cylinder drive 108 from a horizontal transporting position resting in and pinned to cradle 110 to its vertical operating position. Brackets 112 carry four guy line drums 114 and hydraulic motors 116 for driving the drums. Brake mechanisms 120 are adapted to brake the drums 118 when desired. The tightline drum 40 is driven by hydraulic motor 122 and a straw line drum 124 is driven by hydraulic motor 126, line 127 being usable as a haulback in situations where the tightline does not slope down from the slider. The straw line also may be used to pull out the heavier tightline and anchor lines and can be used as a mainline, as for example when the skidder is away from the slider for awhile. An engine 128 on the frame 90 drives a pump 130, which pumps oil under pressure to and from a reservoir 132, and supplies power when needed to valved lines to the hydraulic motors. A fuel tank 134 is mounted at one side of the engine. At the upper end of the mast 38 is a clevis 140 carrying the pulley 36. Four pins 142 act as guides for four guy lines 144 secured to anchors such as, for example, stumps (not shown).

The block 46 may be considered to be an open type of snatch block, and has side plates 150 and 152 joined together rigidly at their bottom ends by an arcuate bridge 154 integral with the plates. The plates support an axle 156. An upper plate portion 158 forms an arcuate slot 160 with the upper end of the plate 150, through which slot the mainline may be passed laterally into and out of the block. The plate 158 forms one side of a cup-like portion of the block with the upper portion of the plate 152 and portions 162. A pin 164 is fixed to the block and has an eye 166 pivotally mounted on pin 168 of the carriage 42. The slot 160 is positioned up above the top of the pulley 54 and is arcuate so that the cable will not come out of the block accidentally.

The carriage 42 includes side plates 170 secured together by pins 172, and mounts the sheaver of pulleys 44 on pins 174. The brake 72 includes a lever 176 having a handle 178 and mounted pivotally on a pin 180. A grooved brake shoe 182 on the inner end of the lever is adapted to join the tightline 30 against the pulleys to prevent movement of the carriage relative to the cable to the left, as viewed in FIG. 5 to stop movement of the carriage toward the slider. The carriage is free to move to the right away from the slider. The lever preferably is biased either toward braking or toward a retracted or releasing position by an overcenter spring 184.

The slider and mainline may be controlled by a remote radio control operable by the choker setter. The skidder operator's control being overriden by the control of the choker setter. With such a remote control, after slider and skidder are set in operating position, the skidder operator lowers the tightline to waist high position, he places the mainline line into the block 46. He then raises by remote control the slider tightline. He leaves the mainline line in free spool then gravity takes the mainline and carriage out to the choker setter. The choker setter actuates his remote control to override the control of the skidder operator and stops the mainline and carriage precisely at the desired point. Then the choker setter uses his remote control to cause the tightline to be slackened to lower carriage and mainline to a reachable height. The choker setter then sets the hand brake on the carriage. At this point, the choker setter sets the mainline again in free spool, and then pulls the chokers and mainline to the logs and fastens the choker to the logs. The logs are then pulled up the tightline by means of the mainline to the slider and skidder. The skidder operator then takes over. After the turn of logs reach the slider site, the slider tightline is again lowered and the mainline is removed from the block by the skidder operator, logs still being attached to the skidder line. The logs then can be skidded to a desired loading area or an out of the way place. Then the chokers are removed and the operation is repeated.

With the logging systems described above, no separate operator is needed in the slider, only two men, the skidder operator and the choker setter. By the choker setter using either of the above-described remote control systems to operate the winch on the skidder rather than uncontrolled brute force as in the conventional way enables the choker setter to guide movement of the logs and eliminates damage to standing timber. Also, the present invention enables one to use already established logging roads. It needs no dug out landings. There is still room for traffic to pass. Also, since the mainline can be taken free from the carriage block at any point desired, then the logs can be taken to a loading point which is also the established road. The off the ground logging method of the present invention eliminates soil erosion and impaction caused from dragging logs over the ground. The skidder used in conjunction with the slider makes it possible to log steep or flat ground during adverse weather conditions or at any time without the danger of impaction or erosion caused by running equipment in the forest.

What is claimed is:

1. In a tightline logging system, comprising
a vehicle slider,
a vertical mast mounted on the vehicle slider,
a mast sheave on the upper end of the mast,
a tightline winch on the vehicle slider,
a tightline extending from the winch and over the sheave and outwardly and downwardly to a ground anchor,
a carriage on the tightline movable outwardly from the mast by gravity,
an open block carried by the carriage,
a skidder vehicle having means for detachably coupling said vehicle slider to said skidder vehicle,
a mainline winch mounted on the skidder,
and a mainline extending through the block from the mainline winch and adapted to be secured to a load and pull the carriage and the load toward the mast,
the open block permitting the mainline to be removed laterally therefrom to permit the skidder to haul the load to a position remote from the slider.

2. The tightline logging system of claim 1 including a selectively operable brake on the carriage for holding the carriage against movement toward the mast.

3. The tightline logging system of claim 1 wherein the block normally holds the cable against lateral insertion and removal into and out of the block during use and has an open side permitting lateral insertion and removal of the cable into and out of the block.

4. The tightline logging system of claim 1 including a power source on the slider for driving the tightline winch.

5. The tightline logging system of claim 4 including remote control means for operating the tightline winch.

6. The tightline logging system of claim 5 wherein the remote control means also includes means controlling the mainline winch.

7. The tightline logging system of claim 6 wherein the remote control means includes control means at the working area of a choker setter to permit the choker setter to operate the mainline winch and the tightline winch.

8. In a tightline logging system, comprising
a mast,
a tightline winch,
power means for driving the tightline winch,
a slider vehicle carrying the mast, the tightline winch and the power means,
a tightline extending from the tightline winch and the mast to an anchor,
a carriage movable along the tightline,
open block means carried by the carriage,
a mainline having an outer end portion extending through the open block means, and said open block means permits said mainline to be laterally removed therefrom,
a powered mainline winch connected to one end of the mainline,
and a separate mobile unit supporting the mainline winch and having means for detachably coupling said slider vehicle to said mobile unit.

9. The tightline logging system of claim 8 wherein the mobile unit is a skidder.

10. The tightline logging system of claim 8 including remote control means for operating the tightline winch and the mainline winch.

11. The tightline logging system of claim 8 including remote control means for operating the tightline winch.

* * * * *